United States Patent [19]

Fraser et al.

[11] 4,266,106

[45] May 5, 1981

[54] LIFT TRUCK LOAD POSITION SENSING DEVICE

[75] Inventors: Daniel M. Fraser, W. Bloomfield; John E. Hausner, Grosse Pte. Farms; William J. Hawkins, Plymouth; Frederick K. Comiskey, Troy, all of Mich.

[73] Assignee: The Stroh Brewery Co., Detroit, Mich.

[21] Appl. No.: 27,235

[22] Filed: Apr. 5, 1979

[51] Int. Cl.[3] ..... H01H 3/16

[52] U.S. Cl. ..... 200/61.44; 200/47; 340/686; 414/275

[58] Field of Search ..... 200/61.44, 47; 414/270, 414/274, 275, 628–638; 340/686, 687, 679; 180/274

[56] References Cited

U.S. PATENT DOCUMENTS

| | | | |
|---|---|---|---|
| 2,879,350 | 3/1959 | Howell | 200/61.41 |
| 2,902,105 | 9/1959 | Wiley et al. | 200/61.44 X |
| 3,012,225 | 12/1961 | Holt et al. | 340/61 |
| 3,034,675 | 5/1962 | Quayle | 414/668 |
| 3,560,678 | 2/1971 | Richardson | 200/61.44 |
| 3,560,922 | 2/1971 | Wilson | 340/61 |

*Primary Examiner*—J. V. Truhe
*Assistant Examiner*—Morris Ginsburg
*Attorney, Agent, or Firm*—Harness, Dickey & Pierce

[57] ABSTRACT

A load position sensing device for load carriers, such as the fork lift of a fork lift truck, wherein the load carrier includes vertical support means and horizontal load-carrying means extending forwardly therefrom, comprising a plate mounted pivotally onto the vertical support means of said load carrier and movable toward and away from the vertical support means in the direction in which the horizontal load-carrying means extends, spring means biasing the plate away from the vertical support means, position sensing means to detect when the load is within a proper range or too close to the vertical support means, and indicator means to communicate the position sensed to an operator of the load carrier whereby potential damage to loads of frangible goods is minimized.

8 Claims, 3 Drawing Figures

LIFT TRUCK LOAD POSITION SENSING DEVICE

BACKGROUND AND SUMMARY OF THE INVENTION

The present invention relates generally to load position sensing devices for load carriers, such as fork lifts on fork lift trucks, where a load is to be transported by a carrier device that potentially may damage the load if a proper position is not maintained by the carrier.

Several types of position sensing devices exist in the art. Position sensing devices, such as in U.S. Pat. No. 3,034,675, have been designed to relate the position of a shelf below the forks of a lift truck to indicate when the forks have been extended a proper distance inwardly of the shelf edges. Other bumper type position sensors have been utilized to detect the existence of a load, such as in U.S. Pat. No. 3,560,678.

The problems faced with load carriers, such as fork lifts, in transporting frangible goods, however, are unique to a warehouse storage environment and are long-standing in the field. Warehouses store packaged goods such as bottles, cans, food stuffs, and other products on pallets. The packages generally have enough strength to support other packages of the same type in stacking the packages in a vertical direction, but the siding of the packages generally is not designed to withstand lateral loads caused by shifting or undue compression of the packages in order to keep the packaging costs to a minimum.

If the lift is too close to the load, the vertically extending support means will push the packages on the pallet load too closely together when lifted and increase the possibility of product damage. If the pallet load is not close enough to the vertical support means of the lift, the pallet load will tip away from the lift as it is raised, thereby again forcing the packages together or spilling a portion of the load. Also, when the fork lift approaches a pallet load, the verticl support means of the lift may get too close to the load, directly apply a lateral force to the load on the pallet, and damage the goods.

Accordingly, it is one object of the present invention to provide a load position sensing device for fork lifts or other similar load carriers which transport pallet loads of potentially frangible materials, which indicates to the operator of the load carrier that the load is in a proper position to be lifted and transported, whereby the possibility of product damage will be reduced by having the vertical support means of the load carrier a proper distance from the load when the load is lifted.

Another important consideration in the transport of pallet loads, particularly where the carrier device is a fork lift, is side-to-side tipping due to misplacement of the forks under the pallet prior to raising the forks. Accordingly, it is another object of the invention to provide a load position sensing device that also will accomplish the above objects without totally obscuring the operator's vision of the forks of the fork lift, so that the operator may be able to obtain proper lateral placement of the forks.

Another object of the present invention is to provide a device that is sturdy and durable in a fast-paced, rough-handling warehouse storage environment, yet relatively easy to manufacture and repair.

Other objects and advantages of the instant invention will be apparent in the following specification, claims and drawings.

DESCRIPTION OF THE PREFERRED EMBODIMENT

Figure 1:
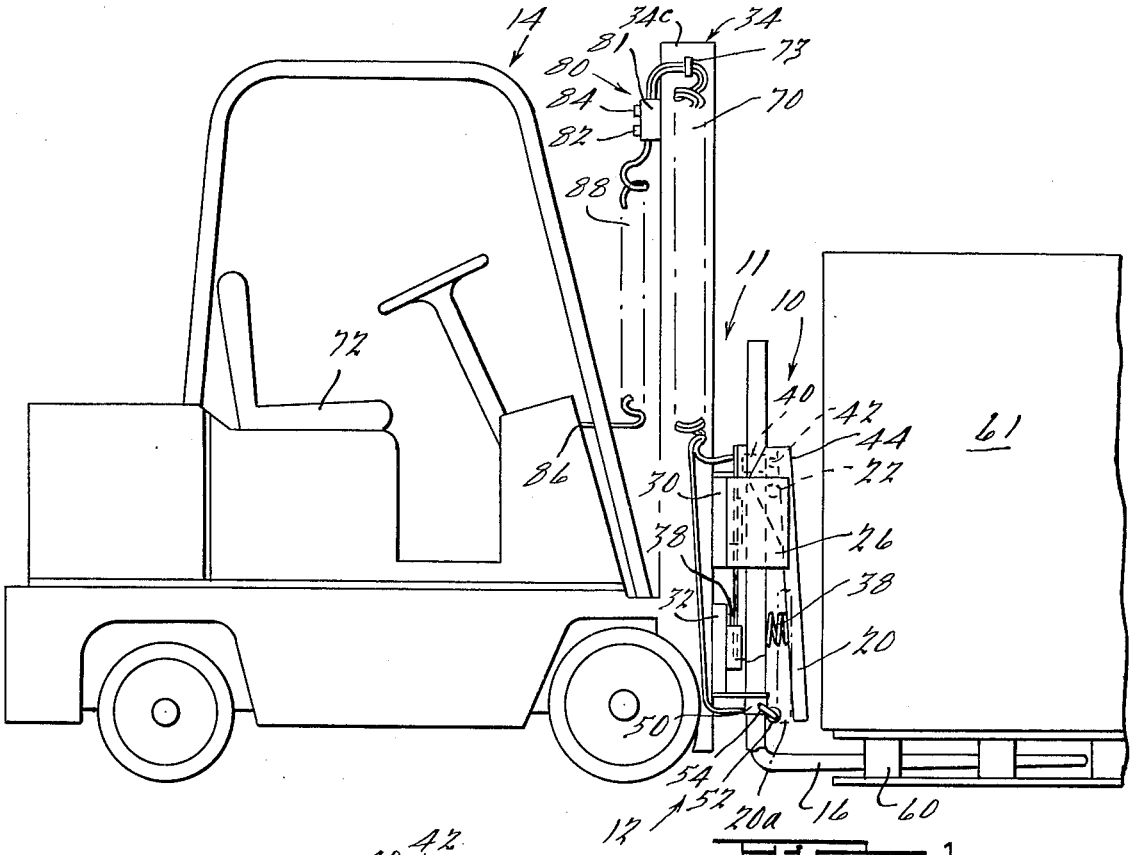
FIG. 1 is a side elevational view of a load position sensing device of the present invention mounted on a fork lift truck, with a portion of fork 16 broken away.

Referring now to FIG. 1, a load position sensing device 10 embodying the principles of the present invention is illustrated mounted on the fork lift 12 of a fork lift truck 14, having a horizontal load-carry portion comprising forks 16 and 18 extending forwardly from the vertical support means 11 of the lift 12. The forks 16 and 18 are shown in a position either approaching or withdrawing from operable association with a pallet 60 having a load of frangible goods 61.

Vertical support means 11 comprises cross-members 30 and 32 fixedly attached to vertical support columns 34 and 36 in a conventional manner. Mounting brackets 26 and 28 are mounted to cross-member 30, preferably by bolting the brackets 26 and 28 to the cross-member 30. An articulating backrest or plate 20 is mounted between the mounting brackets 26 and 28 at pivots 22 and 24 such that the plate 20 has a horizontal pivotal axis whereby the plate 20 pivots toward and away from the vertical support columns 34 and 36. The plate 20 extends downwardly from the pivots 22 and 24.

Vertical support columns 34 and 36 are comprised of stationary columns **34*c* and 36*c* and vertically movable columns 34*a*, 36*a*, 34*b* and 36*b*. The vertically movable columns 34*a*, 36*a*, 34*b*, and 36*b* allow the forks 16 and 18 to reach a position vertically higher than the top of the lift truck 14. A detailed description will not be given here since the vertical support columns 34 and 36 and cross-members 30 and 32 are conventional on fork lift trucks 14** of the type shown.

Figure 3:
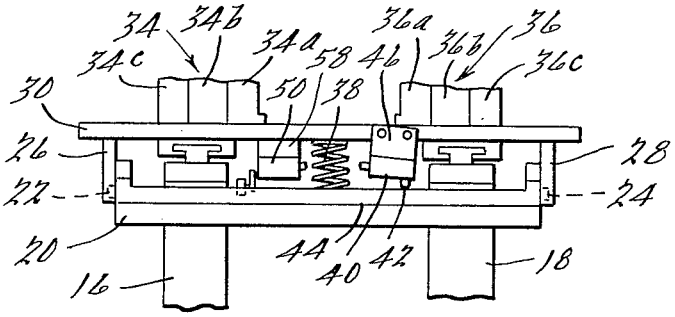
FIG. 3 is an elevated top view of the device of the present invention mounted on a fork lift truck, with portions of the truck, the forks and the wiring broken away.

As seen in FIG. 1, the plate 20 is biased outwardly by a coil spring 38, mounted to the plate 20 but resting freely on cross-member 32. In the preferred embodiment, two electromechanical limit switches 40 and 50 are mounted to cross-members 30 and 32. Limit switch 40 is a normally open switch having a push button contact element 42. The contact element 42 contacts the vertically upper portion 44 of the plate 20 above the pivots 22 and 24 when the plate 20 is not in contact with a pallet 60, but solely biased by the coil spring 38. Limit switch 40 is mounted on the vertically upper surface 41 of cross-member 30 by bracket 46 as seen in FIG. 3.

Limit switch 50 is also a normally open switch in the preferred embodiment, having a contact portion comprising a roller 52 and lever arm 54. The limit switch 50 is mounted below the pivots 22 and 24 and on the downwardly facing surface 56 of cross-member 32 by bracket 58 in a conventional manner.

The limit switches 40 and 50 are wired into an electrical circuit by a helically-wound protected wire cord 70 which is located, as shown in FIG. 1, on the side of the lift 12 opposite the operator's seat 72 of the truck 14 so that the cord 70 does not obstruct the operator's forward vision. The cord 70 is attached at bracket 73 at the top of the stationary vertical column 34*c* of the lift 12. The helical windings allow the cord 70 to be extended as the forks 16 and 18 rise above the top of the truck 14 and above the top of the stationary vertical column 34*c* of the lift 12, while allowing the cord 70 to retract in length and not be a visual restriction when the fork lift 12 is located in the position shown in FIG. 1 or any other intermediate vertical position. Indicator means 80 is mounted on the stationary vertical column 36*c*, above the operator's seat 72. The indicator means 80 is comprised of a housing 81 and two lights, one red 82 and one yellow or green 84 in the preferred embodiment, which are connected to respond to the operation of limit switches 50 and 40 respectively. The circuit is completed through the lift truck battery (not shown) connected to the indicator means 80 by a protected wire cord 88 at position 86.

The limit switches 40 and 50 may be either normally open or normally closed depending upon the circuit or the lighting arrangement desired. In the preferred embodiment, the yellow or green light 84 will remain illuminated any time the load 61 is in contact with the plate 20 after moving the plate 20 to open the contact 42 of the switch 40. The red light 82 will only be illuminated when switch 50 is tripped as the plate 20 and pallet 60 come into undesired proximity with the vertical support columns 34 and 36 of the lift 12 and contact the roller 52 and lever arm 54 to trip the switch 50. This extreme loaded position of undesired proximity is shown by the dotted plate 20*a* in FIG. 1.

The undesired proximity or extreme loaded position of the load relative to the vertical support columns 34 and 36 of the lift 12 may be defined in various ways. In the preferred embodiment, the red light 82 will be illuminated when the plate 20 has passed beyond a position in which the plane of the backrest 20 is parallel to the plane formed by the vertical support columns 34 and 36 of the vertical support means of the lift 12. Depending on the pivotal mounting position 22 and 24 for the backrest 20, however, the point of illumination may also be at the point that the backrest 20 is parallel to the plane of the vertical support columns 34 and 36 or even in some cases before the parallel position is reached.

Figure 2:
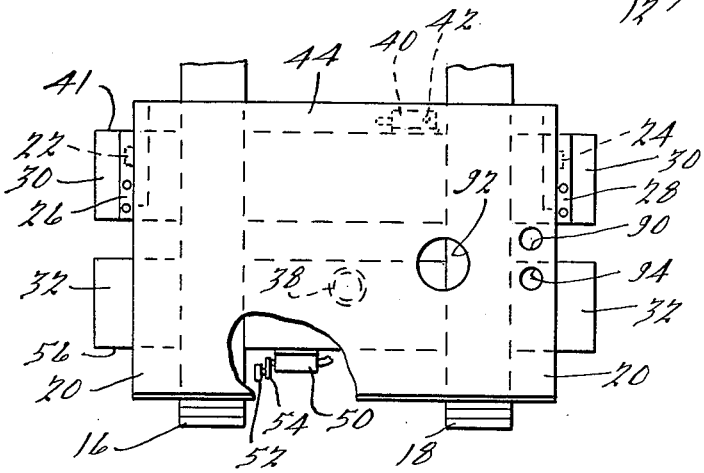
FIG. 2 is an elevated front view of the device of the present invention as mounted on a fork lift truck with a portion of plate 20 broken away and the wiring to limit switches 40 and 50 broken away.

The plate 20 has observation holes 90, 92 and 94 located on the driver's side of the plate 20, as shown in FIG. 2. The observation holes 90, 92 and 94 allow the driver to see the position of the forks 16 and 18 when they are placed within a pallet 60 so that the driver may center the forks 16 and 18 laterally under the load 61 to prevent side-to-side swaying or tipping.

The above description and drawings disclose embodiments of the invention which fully and effectively accomplish the objects thereof. However, it will be apparent that variations in the details of the apparatus may be indulged in without departing from the sphere of the invention herein described, or the scope of the appended claims.

What is claimed is:

1. In combination with a load carrier having vertical support means and horizontal load-carrying means extending forwardly from and substantially perpendicularly from said vertical support means, a position sensing device to determine the position of a load with respect to said load carrier, comprising a plate, mounted pivotally onto said vertical support means of said load carrier and movable toward and away from said vertical support means in the direction in which said horizontal load-carrying means extends;

spring means biasing said plate away from said vertical support means;

position sensing means to detect first and second positions of said plate relative to said vertical support means, wherein said first position detects a load contacting said plate, and said second position detects that said load is located too closely to said vertical support means; and means to indicate said first and second positions from said position sensing means to an operator of said load carrier.

2. A claim in accordance with claim 1, wherein the pivotal axis of the plate is generally horizontal and said plate extends downwardly from said pivotal axis.

3. A claim in accordance with claim 1, wherein said position sensing means comprises at least two electromechanical limit switches, said limit switches are connected to said indicator means by a helically-wound, protected cord of electrical wire, said vertical support means comprises vertically movable columns and two stationary columns, and said protected cord is attached to the top portion of one of said stationary columns at a point between the end connections of the cord to said indicator means and said position sensing means.

4. A claim in accordance with claim 1, wherein said plate has at least one observation hole.

5. A claim in accordance with claim 1, wherein said indicator means is visual, comprising a housing and two lights, wherein a first light is connected to said position sensing means to indicate when said first position has been reached, and a second light is connected to said position sensing means to indicate when said second position has been reached.

6. In combination with a fork lift having vertical columns and a horizontal load-carrying portion extending forwardly and substantially perpendicularly therefrom, a load position sensing device comprising at least one plate, mounted pivotally to at least one of said vertical columns and movable toward and away from said vertical columns in the direction in which said horizontal portion extends having an upper portion and a lower portion, at least one spring for each said plate biasing said plate away from said vertical columns, two electromechanical switches, one switch being in contact with said plate when said plate is fully biased outwardly by said spring, the other switch operating when the lower portion of said plate has moved into a position of undesired proximity to said vertical columns; and means to indicate the status of each of said switches.

7. A claim in accordance with claim 6, wherein the pivotal axis of said plate extends horizontally across said columns, and one of said switches is mounted above said pivotal axis and the other of said switches is mounted below said pivotal axis.

8. In combination with a fork lift of a fork lift truck, said fork lift having vertical columns and a set of two parallel forks extending horizontally at generally a right angle therefrom and mounted thereon, said vertical columns having two cross-members affixed at the lower portion thereof, above the mounting position of said forks, a load position sensing device comprising a metal plate mounted pivotally to said vertical columns above the mounting position of said forks and movable toward and away from said vertical columns, having a pivotal axis horizontally positioned across said vertical columns;

spring biasing means mounted between one of said cross-members and said plate in a position located vertically below the pivotal axis of said plate;

two electromechanical limit switches, having mechanically movable contacts, one switch mounted above said pivotal axis of said plate on one of said cross-members wherein said plate abuts the contact of said switch in an unloaded position when said plate is biased outwardly by said spring means, and the other switch mounted below said pivotal axis of said plate on the other of said cross-members wherein said plate abuts the contact of said other switch in an extreme loaded position; and visual means to indicate the position of the plate as determined by the position of the contacts of the limit switches.

* * * * *